US006340008B1

(12) United States Patent
Boie et al.

(10) Patent No.: US 6,340,008 B1
(45) Date of Patent: Jan. 22, 2002

(54) METHOD FOR CONTROLLING AN ELECTROMAGNETIC ACTUATOR FOR ACTIVATING A GAS EXCHANGE VALVE ON A RECIPROCATING INTERNAL COMBUSTION ENGINE

(75) Inventors: Christian Boie; Hans Kemper, both of Aachen; Lutz Kather, Würselen; Gilles Corde, Aachen, all of (DE)

(73) Assignee: FEV Motorentechnik GmbH, Aachen (DE)

( * ) Notice: Subject to any disclaimer, the term of this patent is extended or adjusted under 35 U.S.C. 154(b) by 0 days.

(21) Appl. No.: 09/744,688

(22) PCT Filed: May 20, 2000

(86) PCT No.: PCT/EP00/04584

§ 371 Date: Jan. 29, 2001

§ 102(e) Date: Jan. 29, 2001

(87) PCT Pub. No.: WO00/73634

PCT Pub. Date: Dec. 7, 2000

(30) Foreign Application Priority Data

May 27, 1999 (DE) ..... 199 24 374
Apr. 20, 2000 (DE) ..... 100 19 745

(51) Int. Cl.[7] ..... F01L 9/04

(52) U.S. Cl. ..... 123/90.11; 251/129.01; 251/129.15

(58) Field of Search ..... 123/90.11; 251/129.01, 251/129.1, 129.15, 129.16

(56) References Cited

U.S. PATENT DOCUMENTS 5,671,705 A * 9/1997 Matsumoto et al. ..... 123/90.11
5,782,211 A * 7/1998 Kamimaru ..... 123/90.11
5,799,630 A * 9/1998 Moriya et al. ..... 123/90.11
6,024,059 A * 2/2000 Kamimaru et al. ..... 123/90.11
6,044,814 A * 4/2000 Fuwa ..... 123/90.11
6,047,672 A * 4/2000 Hanai et al. ..... 123/90.11
6,176,208 B1 * 1/2001 Tsuzuki et al. ..... 123/90.11

FOREIGN PATENT DOCUMENTS

| | | |
|---|---|---|
| DE | 44 34 684 | 4/1996 |
| DE | 196 05 974 | 8/1997 |
| DE | 197 23 931 | 12/1998 |
| EP | 0 916 814 | 5/1999 |

* cited by examiner

*Primary Examiner*—Weilun Lo
(74) *Attorney, Agent, or Firm*—Venable; Gabor J. Kelemen

(57) ABSTRACT

The invention relates to a method for controlling an electromagnetic actuator for activating a gas exchange valve on a reciprocating internal combustion engine, said gas exchange valve having two electromagnets that are set apart from each other and between which an armature that acts on the gas exchange valve against the force of at least one return spring is guided in such a way that it can move back and forth between the pole faces of the two electromagnets. The electromagnets are alternately subjected to a receiving current by means of a control unit and the movement of the armature on its path from one pole face to the other is detected by means of a sensor unit. Actual values relating to the movement of the armature are detected by the sensor unit in a first phase (I) beginning with the start of the release of the armature from the pole face of the holding electromagnet; the receiving electromagnet is controlled by the control unit in terms of the supply of current, according to the detected actual values relating to the movement of the armature, in a second phase (II), in such a way that the armature moves at a predetermined speed and with an acceleration around zero, within a predetermined range away from the pole face of the receiving electromagnet; and in a third phase (III), the supply of current of the receiving electromagnet is influenced in such a way that the armature meets the pole face at a predetermined minimum speed.

6 Claims, 2 Drawing Sheets

Figure 1:
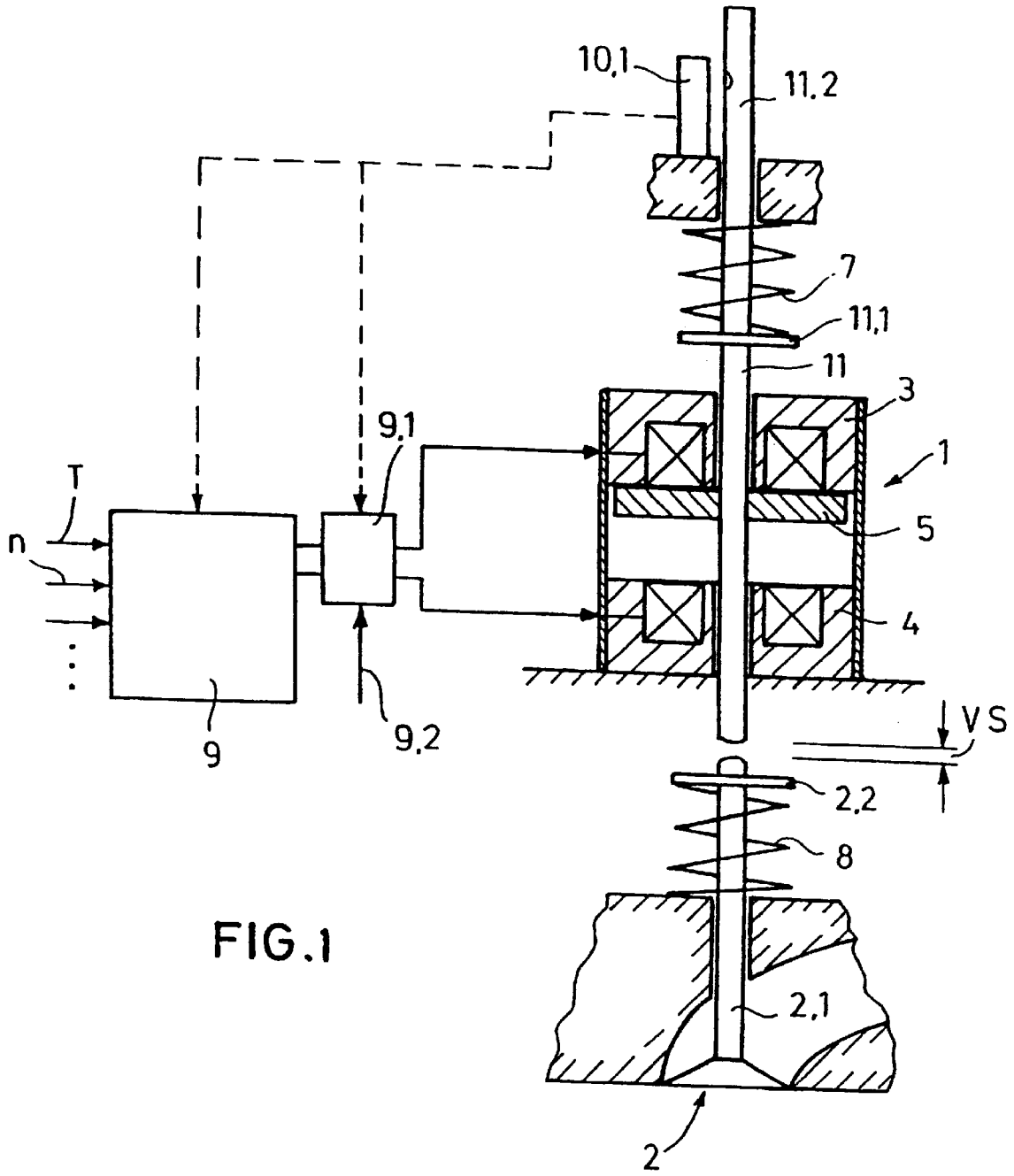

METHOD FOR CONTROLLING AN ELECTROMAGNETIC ACTUATOR FOR ACTIVATING A GAS EXCHANGE VALVE ON A RECIPROCATING INTERNAL COMBUSTION ENGINE

An electromagnetic actuator for actuating a cylinder valve in a piston-type internal-combustion engine essentially comprises two spaced electromagnets, whose pole faces face one another, and between which an armature that acts on the cylinder valve to be actuated is guided to move back and forth, counter to the force of at least one restoring spring, between an open position and a closed position for the cylinder valve. One of the electromagnets serves as a closing magnet, by means of which the cylinder valve is held in the closed position, counter to the force of the opening spring, while the other electromagnet serves as an opening magnet, by means of which the cylinder valve is held in the open position by way of the armature, counter to the force of the associated closing spring.

The arrangement is such that, in the resting position, the armature assumes a center position between the two pole faces. When the two electromagnets are alternately supplied with current, the armature comes into contact with the pole face of the respective supplied, and therefore capturing, electromagnet, counter to the force of a restoring spring. If the retaining current to the retaining electromagnet is turned off, the force of the restoring spring accelerates the armature in the direction of the other electromagnet, which is acted upon with a correspondingly high capturing current during the armature movement, so after overshooting the center position, the armature comes into contact due to the magnetic force, counter to the force of the restoring spring associated with the respective capturing electromagnet.

The electromagnetic actuator is controlled as a function of the operating data of the piston-type internal-combustion engine, essentially the load requirement and the rpm, which are available to the engine control unit. If the cylinder valve is, for example, in its closed position, i.e., the armature rests against the closing magnet, the control is a function of time - in other words, the engine control unit effects the control with consideration of the crankshaft position and the parameters from the load specification, which respectively determine the opening and closing times for the cylinder valve. The turn-off of the relatively low retaining current initiates the beginning of the armature movement, so the capturing current to the capturing electromagnet can be turned on after a predeterminable delay following the turn-off of the retaining current to the capturing electromagnet. The delay can be determined by way of previous empirical data, or theoretical data.

The time of the turn-off of the retaining current must be determined precisely, but is not identical to the time of the beginning of the armature movement, because the electromagnetic processes, such as the slow breakdown of the retaining magnetic field, and external influences, such as gas counterpressure counter to the cylinder valve to be opened, frictional resistances, etc., result in a so-called "sticking time" for the armature. The actual armature movement therefore does not begin until after a specific delay following the turn-off of the retaining current.

If the capturing current is now initiated, as the armature continues to approach the pole face of the capturing electromagnet with a constant current supply, the magnetic force increases progressively, whereas the force of the restoring spring acting in the opposite direction only increases linearly. Consequently, the armature accelerates increasingly in the end phase, shortly before impacting the pole face of the capturing electromagnet, so the armature impacts the pole face hard, which is undesirable for several reasons: It produces physical or airborne sound and consequently promotes the development of noise. To avoid this, an appropriate control of the capturing current is aimed at reducing the current shortly before the armature impacts the pole face of the respective capturing electromagnet; a sensor element is used to detect the armature approach. This can be effected in that, when a predetermined armature position in the vicinity of the pole face is reached, a corresponding control signal is emitted, or the armature movement in this region is detected. The engine control unit, or a separate current control for the actuator, can use these approach values for the actuator for reducing the capturing current such that the armature impacts the pole face gently, i.e., at a speed only slightly greater than "zero," so the impacting electromagnet is only acted upon by the low retaining current.

These known control means are, however, inflexible, and do not take into account the numerous external interfering forces that act on the system comprising the armature and the cylinder valve, on the one hand, and on the other hand, they do not sufficiently minimize the development of noise.

It is the object of the invention to create a method that permits a much more precise control of an electromagnetic actuator.

In accordance with the invention, this object is accomplished by a method for controlling an electromagnetic actuator for actuating a cylinder valve in a piston-type internal-combustion engine, having two spaced electromagnets, between which an armature acting on the cylinder valve is guided to move back and forth between the pole faces of the two electromagnets, counter to the force of at least one restoring spring, with the electromagnets being alternately acted upon with a capturing current by way of a control, and with a sensor element detecting the movement of the armature on its path from the one pole face to the other pole face, specifically such that, in a first phase beginning with the initiation of the detachment of the armature from the pole face of the retaining electromagnet, the sensor element detects the actual values of the armature movement; in a second phase, as a function of the detected actual values of the armature movement, the control actuates the capturing electromagnet with regard to the current supply such that the armature is moved, at a predetermined speed and an acceleration approaching "zero," in a predeterminable spacing range from the pole face of the capturing magnet; and in a third phase, the current supply to the capturing electromagnet is controlled such that the armature impacts the pole face at a predeterminable minimum speed. The "initiation of the detachment of the armature" is defined by the time of the turn-off, preferably the purposeful reduction, of the retaining current. The term "actual values of the armature movement" encompasses not only the time of the turn-off of the retaining current in the first phase, but also the respective position, speed and acceleration of the armature in at least the first and second phases. Depending on the nature of the sensor element, in addition to the armature position, the armature speed can be detected directly, or, like the acceleration, derived from the path derivation over time, which results from the detection of position.

The division of the armature movement into three phases takes into account the physical qualities of the actuator, namely its individual mechanical qualities and the qualities that change over the course of operation of the piston-type internal-combustion engine. In the first phase, the armature movement is only "observed," during which the energetic initial position of the armature movement is detected, the position being essentially predetermined by the actual time of the detachment from the pole face and by the force of the restoring spring that accelerates the armature, as well as by the counteracting frictional forces and gas-pressure forces. When the armature is detached, unavoidable energy losses in the mechanical system occur in the vicinity of the electromagnet due to the residual field acting in the opposite direction. These negative electromagnetic force influences can be minimized through the use of a low-eddy-current armature and/or the supply of a current of a different polarity, which generates a magnetic field that has a repelling effect on the armature.

As soon as the armature has perceptibly detached from the pole face of the previous retaining electromagnet, it is no longer possible to influence the armature, either through a corresponding supply of current to the previous retaining electromagnet or through a premature supply of current to the capturing electromagnet with a current intensity that is justifiable from the standpoint of the power outlay. The armature travels at its highest speed when passing through the center position. In this region, other influences, such as internal cylinder pressure, frictional influences or other actuator parameters, can impact the armature movement, but are scarcely influenced by the magnetic force. Therefore, at low rpms of the piston-type internal-combustion engine, and correspondingly low movement speeds of the cylinder valves and thus of the armature, it is particularly advantageous not only to control the current supply to the capturing electromagnet. The purposeful guidance of the current supply to the releasing electromagnet, instead of a simple turn-off of the current, permits the influencing of the course of armature movement in this phase as well, and the forcing of a predetermined course of movement at the beginning of the movement.

If, as provided in the method of the invention, the sensor element detects the actual values of the armature movement in the first and second phases, it is possible for the respective interferences that act on the armature in the first phase, and are essentially caused by detachment processes and external influences, such as the internal cylinder pressure to be overcome, and the interferences that are essentially caused external influences in the second phase, to be supplied as control signals to the control or the individual actuator control; it is also possible to actuate the capturing magnet, with regard to the current supply, in the second phase such that the armature moves at a predetermined speed and an acceleration that approaches "zero" in a predeterminable spacing range, a so-called "target window." This permits an individual adaptation of the current supply of the respective capturing electromagnet, but also of the electromagnet that releases the armature, with the consideration of the external interfering influences acting on the armature during the first two phases of the movement. This is sufficient if the specifications with regard to speed and acceleration are met in the spacing range at the releasing and the capturing electro magnet, because it is possible to purposefully guide the beginning and end of the armature movement in the immediate effective region of the magnetic fields of these electromagnets by correspondingly controlling the current supply.

The third phase, which begins when the target window is reached, is characterized by a low armature speed and a high force effect of the capturing magnet. In this phase, therefore, the current supply to the capturing electromagnet permits a controlled guidance of the armature counter to the force of the restoring spring until it comes to rest against the pole face, which assures a minimum impact speed.

The detection of the actual values of the armature movement in the first and second phases also permits the presetting of the spacing range with a corresponding actuation such that, instead of the armature impacting the pole face, it can be held to hover at a predeterminable distance from the pole face if, for example, it is undesirable for the armature to reach the end position due to time constraints, as is the case in a so-called free-fall actuation.

Because a controlled influence of the armature movement is possible in the third phase, if valve play exists, it is also possible to close the valve gently for setting the armature gently down on the pole face of the capturing magnet after it has detached from the valve.

In an advantageous embodiment of the invention, it is provided that the spacing range is predetermined as a function of the actual values of the armature movement that are detected at least in the second phase. It can be advantageous for the regulator associated with the actuator to be embodied as a model-based regulator, so the behavior of the system comprising the armature and the cylinder valve can be predicted.

It is especially advantageous for the current supply to the electromagnet to be controlled by way of a control of the voltage applied to the capturing magnet. A voltage control instead of a current control allows the necessary control efforts to have a far faster and more precise effect, because the current drops relatively slowly after the voltage turn-off, and, accordingly, the current increases relatively slowly when a voltage is applied. Because such electromagnetic actuators are usually acted upon with a direct current, it is also possible to brake an armature that is approaching the target window too rapidly through a brief generation of a counterfield by inverting the voltage at the end of the second phase, so the required values are attained in the target window. The voltage inversion is advantageously effected between an operating voltage, the dead setting (freewheeling, short-circuit) and a negative operating voltage (rear feeding).

An increased positive and negative voltage can compel a rapid change in current. The reversal can be effected very quickly. The voltage and current supply are advantageously drawn from the on-board network of the piston-type internal-combustion engine.

It is particularly advantageous when a sensor element having digital signal detection and signal processing detects the actual values of the armature movement. Such a sensor element can directly tap, for example, the position, that is, the path and/or speed at the armature or a guide rod connected to the armature, the rod being embodied as a digital path indicator, so very finely-divided signals that are tapped directly at the armature are available. The method can, however, also be realized with an analog or analog/digital sensor element.

Figure 2:
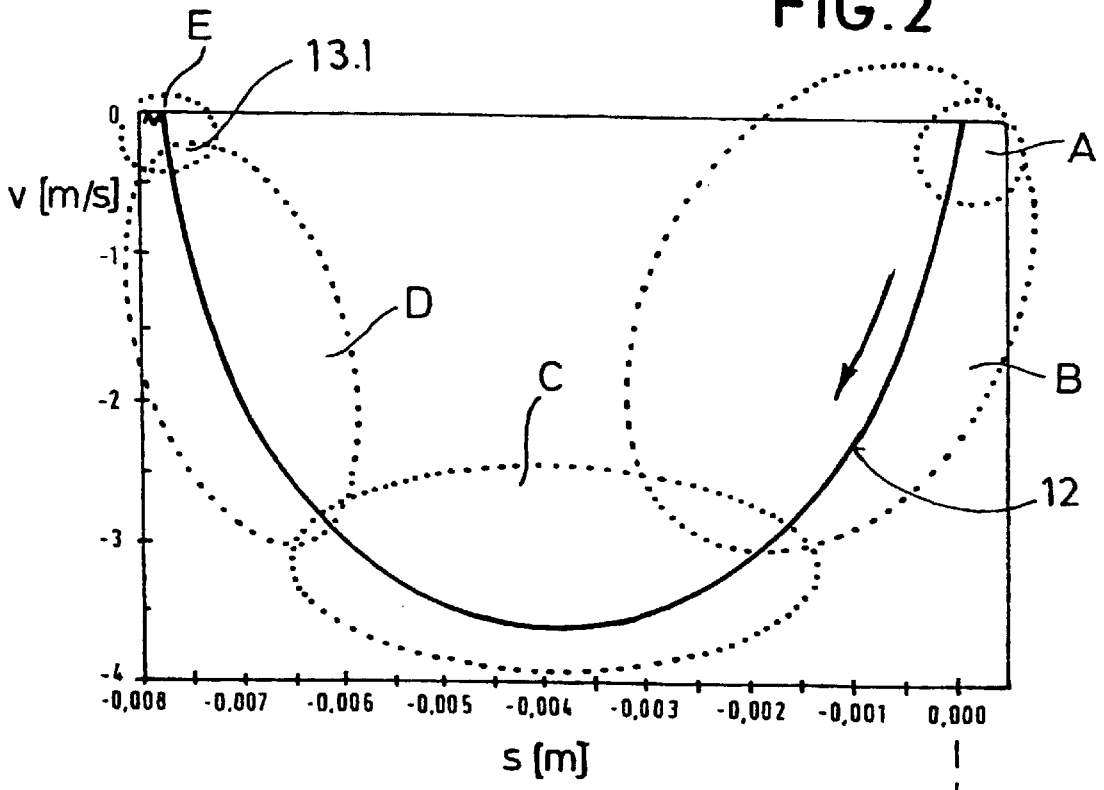

The invention is described in detail in conjunction with schematic drawings. Shown are in:

FIG. 1 an electromagnetic actuator;

FIG. 2 the procedure as illustrated by a movement diagram; and

Figure 3:
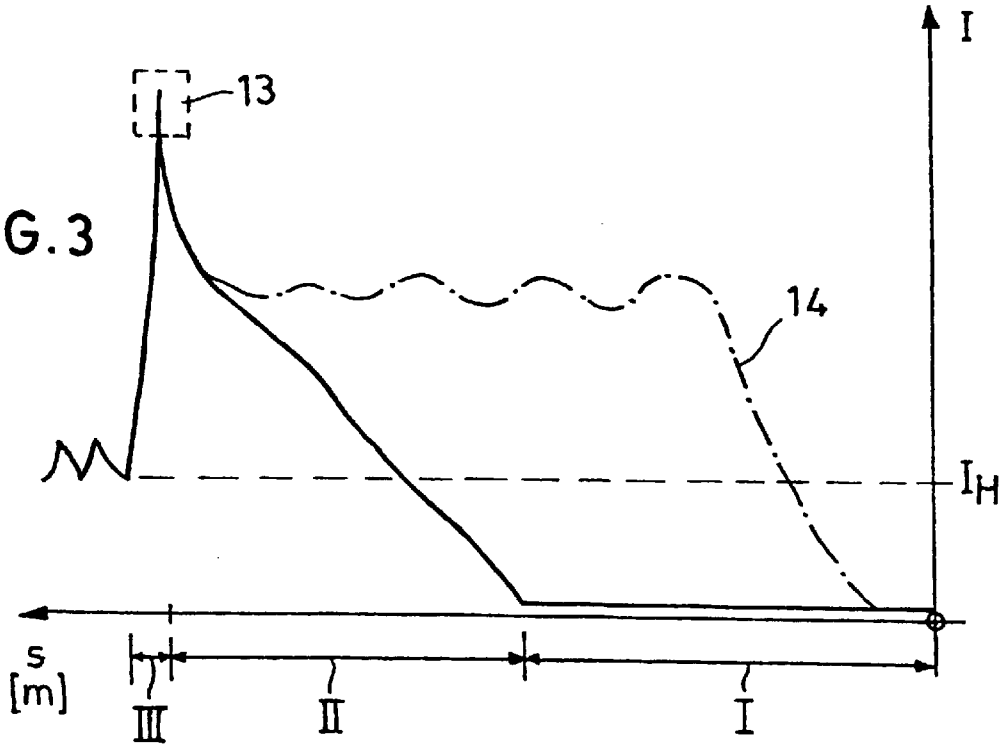

FIG. 3 the current curve associated with the movement diagram of FIG. 2.

An electromagnetic actuator 1 for actuating a cylinder valve 2 essentially comprises a closing magnet 3 and an opening magnet 4, which are spaced from one another, and between which an armature 5 is guided to move back and forth, counter to the force of restoring springs, namely an opening spring 7 and a closing spring 8. In the drawing, the arrangement is shown in the closed position, specifically the "classic" arrangement of the opening spring and closing spring. In this arrangement, the closing spring 8 acts directly by way of a spring disk 2.2 connected to the stem 2.1 of the cylinder valve 2. The guide rod 11 of the electromagnetic actuator is separated from the stem 2.1; usually, a gap is present, in the form of the so-called valve play VS, in the closed position. The opening spring 7 is supported on a spring disk 11.1 on the guide rod 11, so the guide rod 11 is supported in the center position on the stem 2.1 of the cylinder valve 2 due to the opposing actions of the opening spring 7 and the closing spring 8.

It is also possible to provide only a single restoring spring in place of the opening spring 7, the spring being designed to build up a restoring force that corresponds to the overshoot of the armature 5 past the center position. A separate closing spring 8 can thus be omitted. In such an arrangement, however, the guide rod 11 must be connected to the stem 2.1 of the cylinder valve by way of a corresponding coupling element that transmits the back-and-forth movement of the armature onto the cylinder valve 2 in the same way.

The closing spring 8 and the opening spring 7 are usually designed such that, in the resting position, i.e., when the electromagnet is not supplied with current, the armature 5 assumes the center position. From this center position, the electromagnetic actuator 2 [sic] with its cylinder valve 2 must then start to oscillate in a corresponding procedure.

A current regulator 9.1, which is associated with the electromagnets 3 and 4 of the actuator 1, supplies current to the magnets. It is actuated by an electronic engine control unit 9 corresponding to the predetermined control programs, and as a function of the operating data supplied to the engine control unit, such as rpm, temperature, etc. While it is fundamentally possible to provide a central current regulator for all of the actuators of a piston-type internal-combustion engine, for the method in accordance with the invention, it is advantageous for a separate current regulator to be allocated to each actuator, the regulator being connected to a central voltage supply 9.2 and actuated by the engine control unit 9.

Associated with the actuator 1 is a sensor 10.1, which permits the detection of the actuator functions. The sensor 10.1 is illustrated schematically here. Depending on the sensor design, the path of the armature 5 can be detected, for example, so the respective armature position can be transmitted to the engine control unit 9 and/or the current regulator 9.1. In the engine control unit 9 or the current regulator 9.1, corresponding calculations can be employed to determine the armature speed, so the supply of current to the two electromagnets 3, 4 can be controlled as a function of the armature position and/or speed.

The sensor 10.1 need not necessarily be associated with a contact lever 11.1 that is connected to the armature 5, as shown. It is also possible to arrange a correspondingly embodied sensor to the side of the armature 5, or to arrange corresponding sensors in the region of the pole face of the respective electromagnets. The allocation of the sensor 10.1 to a contact rod 11.1, however, advantageously permits a digital signal generation when the contact rod 11.1 is correspondingly embodied as an incremental path indicator.

The current regulator 9.1 further has corresponding elements for detecting current and voltage for the respective electromagnet 3 and 4, and for changing the current curve and the voltage curve. At the beginning and end of the opening times, for example, the engine control unit 9 can then actuate the actuator 1 of the cylinder valve 2 completely variably, as a function of predeterminable operating programs, possibly based on corresponding performance characteristics. The actuation can also be controlled with regard to the height of the opening stroke or the number of opening strokes during the closing time.

With reference to the embodiment according to FIG. 1, in FIG. 2 the line 12 schematically represents the speed curve of the armature 5 after it has detached from the pole face of the retaining electromagnet 3.

This speed curve is essentially divided into five movement regions A, B, C, D and E, which are outlined with dotted lines. The region A covers the immediate vicinity of the pole face of the electromagnet 3, while the region E covers the immediate vicinity of the pole face of the capturing electromagnet 4. The significance of these regions is explained in detail below.

The regions A and B are essentially characterized by the fact that, with an economical coupling of energy into the capturing electromagnet 4 after the retaining current has been turned off, the electromagnet 4 has an extremely low force effect. Because of the very small values, the armature movement can be measured through the coil current in the capturing electromagnet 4, but only with great effort. In these regions, however, external influences such as internal cylinder pressure, frictional influences and system parameters of the actuator can be identified from the armature movement . The system parameters of the actuator also include a change in the movement behavior of the armature due to temperature influences or wear. Sensor signals detected by the sensor element during this phase are processed for identifying these parameters. For this purpose, noise-reduced methods are preferably used, particularly Kalman filters, neuronal networks and state observers. Information about the internal cylinder pressure, as is present in the engine control unit, can be used additionally or exclusively in the processing of the sensor signals, which is advantageously performed in the current regulator 9.1. In particular, the maximum armature speed can be assessed as a measure for the required current level.

The immediate vicinity A of the retaining magnet 3 is further characterized by a strong force effect of the retaining magnet, as long as the retaining current is present here, until the residual magnetic field breaks down. In this region, the armature moves at a low speed immediately after detaching from the pole face. It is therefore possible to influence the initial movement, and thus the initial speed, of the armature through a corresponding current supply to the retaining magnet, such as the supply of a voltage pulse for generating a repelling magnetic field. This means, however, that it is possible to purposefully reduce the energy in the mechanical system, with a low resilience, by a flat movement curve, thereby gently carrying the valve along through the armature pin if valve play is present.

In the region C, which practically represents a quasi-free-flight region, only a low force effect exists, both on the side of the previous retaining electromagnet 3 and the present capturing electromagnet 4, with a very high armature speed. As stipulated by these conditions, it is practically impossible to purposefully influence the movement. This region can therefore also preferably be used to identify parameters that are correlated with the counterpressure, frictional behavior and other interfering variables. This region can, however, also be used for a precise, position-based pilot control, for example for turning on the coil voltage at the capturing electromagnet 4. The actual values of the armature movement that are detected here are also considered in the evaluation in the current regulator 9.1.

When the coil voltage is applied to the electromagnet 4, and the armature 5 moves from the region C into the region D, it enters the still-weak region of influence of the capturing electromagnet 4. The armature enters at high speed. Based on the actual values of the armature movement that were detected in the regions A, B and C, it is now possible to influence the movement of the armature through an appropriate correction of the current level such that the armature only has a low movement speed in the transition to the region E, that is, at a predeterminable, small distance from the pole face; the armature acceleration is practically zero here, and a force equilibrium is practically achieved between the force of the closing spring 8 and the magnetic force of the capturing electromagnet 4. It is therefore possible to completely control the armature movement in the region E, so in a closed-loop control, the armature can be compelled to move, by way of a corresponding control of the current or the voltage, to assure a minimum impact speed. This transition region between D and E represents the so-called "target window," a predetermined spacing range of the armature from the pole face of the capturing electromagnet 4.

Because the sensor element continuously detects the actual values of the armature movement in the regions A, B, C and D, it is possible to select this target window to be far enough from the end position of the armature at the pole face that the armature can be set down onto the pole face with a predetermined minimum impact speed, even under all of the external influences affecting the armature over the course of its movement, which practically precludes bumping. Thus, essentially three phases result for the regulation, namely a first phase I, basically determined by the regions A and B, in which the base data of the armature are detected through observation. Next comes phase II, in which external interfering influences are additionally detected in the regions C and D, and converted into a prediction signal for the current regulator, with consideration of the movement data of phase I, so the "target window" is attained with sufficient precision. In phase III, which is characterized by the region E, the armature is guided into contact with the pole face in a defined movement curve by way of the voltage or current control. The armature speed is preferably predetermined as a function of the armature position.

FIG. 3 illustrates the curve of the coil current in the capturing electromagnet 4 in the described opening movement, as it relates to the representation in FIG. 2. As can be seen from the curve, the electromagnet 4 can initially remain currentless in phase I. When phase II is attained, the capturing electromagnet is supplied with current, and its curve is influenced, as a function of the actual values of the armature movement that were determined in phase I and phase II, such that the predetermined target window in the transition region between phase II and region III [sic] is actuated. As soon as the target window 13 has been attained, the capturing current in the capturing electromagnet 4 can be purposefully stepped down to the level of the retaining current IH, so the valve 2 is in the open position. FIG. 2 illustrates the target window 13 through the intersection region 13.1 between the regions D and E.

It is also possible, however, as indicated by the dot-dash curve part 14, to supply the capturing electromagnet 4 with current in phase I. The current level, which is advantageously clocked, is set such that it approximately corresponds to the level that is anticipated in accordance with the measurement parameters at a predetermined distance of the armature from the pole face. This ensures that the armature will travel prematurely into the region of influence of the "capturing" magnetic field, and its movement can be influenced.

It is advantageous for the curve of the armature speed to be approximated by a function whose parameters are determined from the sensor signal with the use of statistical methods. These parameters can be correlated with the counterpressure acting on the cylinder valve, and used to determine the current level in phase II.

It is advantageous when the intensity of the counteracting internal cylinder pressure, and thus the required current level, are derived from the curve of the armature speed when the armature guide 11 impacts the valve stem 2.1, that is, after the valve play VS has been overcome.

Because the sensor element detects the armature movement and thus provides an ongoing detection of the armature position, it is possible to detect the valve play VS during the opening process, and therefore to preset the target window for the subsequent closing process, and to guide the movement of the armature.

What is claimed is:

1. A method for controlling an electromechanical actuator for actuating a cylinder valve in a piston-type internal-combustion engine, having two spaced electromagnets, between which an armature that acts on the cylinder valve to be actuated is guided to move back and forth, counter to the force of at least one restoring spring, with a control alternately supplying the electromagnets with a capturing current and a sensor element detecting the armature movement on its path from the one pole face to the other pole face, specifically such that, in a first phase (I), beginning with the initiation of the detachment of the armature from the pole face of the retaining electromagnet, the sensor element detects actual values of the armature movement; in a second phase (II), the control actuates the capturing electromagnet, as a function of the detected actual values of the armature movement, and with respect to the current supply, such that the armature is moved in a predetermined spacing range from the pole face of the capturing electromagnet, and with an acceleration that approaches zero; and in a third phase (III), the current supply to the capturing electromagnet is controlled such that the armature impacts the pole face at a predeterminable minimum speed.

2. The method according to claim 1, characterized in that, when the armature detaches from the pole face of the retaining electromagnet, the reduction in the current supply is controlled according to actual values of the armature movement.

3. The method according to claim 1, characterized in that the spacing range is predetermined as a function of the actual values of the armature movement that were detected at least in the second phase (II).

4. The method according to claim 1, characterized in that the current supply is controlled by way of a control of the voltage applied to the capturing electromagnet.

5. The method according to claim 1, characterized in that the voltage applied to the electromagnet is obtained from the on-board network voltage through a voltage inversion and voltage stabilization.

6. The method according to claim 1, characterized in that the actual values of the armature movement are detected by a sensor element having digital signal detection and signal processing.

* * * * *